US006434954B1

(12) United States Patent
Hess et al.

(10) Patent No.: US 6,434,954 B1
(45) Date of Patent: Aug. 20, 2002

(54) AIR CIRCULATION SYSTEM FOR A CHAMBER

(75) Inventors: John C. Hess, Boulder; Loddie Alspach, Kittredge; Wagdy Wahba, Thornton, all of CO (US)

(73) Assignee: QualMark Corporation, Denver, CO (US)

( * ) Notice: Subject to any disclaimer, the term of this patent is extended or adjusted under 35 U.S.C. 154(b) by 0 days.

(21) Appl. No.: 09/579,158

(22) Filed: May 25, 2000

Related U.S. Application Data

(63) Continuation-in-part of application No. 09/564,890, filed on May 4, 2000.

(51) Int. Cl.[7] ..... F25D 17/06; F25D 19/02; F25D 17/04

(52) U.S. Cl. ..... 62/89; 62/448; 62/407; 62/419; 62/426

(58) Field of Search ..... 62/448, 407, 419, 62/426, 89, 440

(56) References Cited

U.S. PATENT DOCUMENTS 3,712,078 A * 1/1973 Maynard et al. ..... 62/448
3,777,199 A * 12/1973 Davis ..... 313/27
4,572,283 A * 2/1986 Vanderschaaf ..... 165/61
4,745,770 A * 5/1988 Mintz ..... 62/263
5,228,313 A * 7/1993 Okamoto et al. ..... 62/407
5,503,032 A * 4/1996 Tikhtman et al. ..... 73/865.6
5,507,157 A * 4/1996 Mase et al. ..... 62/418
5,851,143 A * 12/1998 Hamid ..... 454/57
5,947,812 A * 9/1999 Henning et al. ..... 454/118

* cited by examiner

*Primary Examiner*—William C. Doerrler
(74) *Attorney, Agent, or Firm*—Emery L. Tracy

(57) ABSTRACT

An air circulation system mounted within a chamber is provided. The chamber receives a product to be tested or processed. The air circulation system comprises an enclosure defined within the chamber with at least one inlet formed in the enclosure for receiving air from the chamber. A pair of counter rotating fans are mounted within the enclosure adjacent the inlet for circulating the air. Additionally, at least one air diverter plate is mounted within the enclosure adjacent the fans for diverting the circulating air substantially across the width of the enclosure. Furthermore, at least one air outlet is formed in the enclosure for introducing circulating air into the chamber about the product being tested or processed.

75 Claims, 10 Drawing Sheets

AIR CIRCULATION SYSTEM FOR A CHAMBER

The present application is a continuation-in-part of pending patent application Ser. No. 09/564,890, filed on May 4, 2000, entitled "Air Circulation System for a Chamber".

BACKGROUND OF THE INVENTION

1. Field of the Invention

This invention relates generally to an air circulation system for a chamber and, more particularly, it relates to an air circulation system for a chamber which is easily installable within the chamber and maximizes airflow efficiency through the chamber.

2. Description of the Prior Art

Chambers for testing the reliability and durability of manufactured products are well known in the art. Testing chambers are typically used either under controlled laboratory conditions or in conjunction with an assembly line. The chambers often have circulating air, which gives the added flexibility of testing for defects in the manufactured product which can be exposed by elevated or lowered temperature and/or temperature cycling.

The chambers have a circulating air assembly typically mounted at the top of the chamber for drawing air from the interior of the chamber with at least one fan and then directing the air back to the interior of the chamber. In order to lower the temperature of the test chamber, a cooling substance, coolant, or air flowing over cooled coils is typically introduced into the circulated air within circulating air assembly of the chamber in such a manner as to lower the temperature of the circulated air directed toward and about the tested product. In order to increase the temperature of the circulating air within the chamber, circulating air is typically driven through a heating unit mounted within the circulating air assembly and circulated about the tested product within the chamber.

Sometimes these chambers also include shaker tables having a two-piece platform or mounting table having a top piece upon which a product to be tested is mounted and a bottom piece secured to the top piece by bonding or mechanical fasteners. At least one vibrator assembly is typically attached to the bottom piece of the mounting table by a mounting bolt and vibrates the mounting table thereby vibrating the product mounted upon the mounting table. The vibrator assembly generally consists of a housing having a slidable piston mounted therein. The slidable piston strikes a programmer comprising a shock absorbing material to achieve a predicted predetermined shock response. An accelerometer(s) mounted to the bottom piece measures the acceleration level of the mounting table in one or all orthogonal directions, e.g., the x-axis direction (in plane), the y-axis direction (in plane), and the z-axis direction (out of plane).

A need exists for an air circulation system which effectively increases the efficiency of the air flow through the chamber and allows the easy installation, maintenance, and removal of components therein. Additionally, there exists a need for an air circulation system having an inlet cone which allows air to enter the enclosure in a substantially unimpeded manner and allows the height of the air circulation system to be minimized. Furthermore, a need exists for an air circulation system having counter rotating fans which increase the volume of air flowing through the air circulation system and, thus within the chamber. Further yet, there exists a need for an air circulation system having air diverter plates mounted adjacent the fans to evenly distribute the air flow across the width of the enclosure and through the heating unit, if present. Further still, a need exists a need for an air circulation system having a modular heating unit which can be constructed and installed within the enclosure thereby allowing easy installation, maintenance, and replacement. In addition, there exists a need for an air circulation system having a secondary exhaust system to gain full use of heated or cooled air to assist in heating or cooling the enclosure thereby decreasing the amount of heating and/or cooling required.

SUMMARY

The present invention is an air circulation system mounted within a chamber. The chamber receives a product to be tested or processed. The air circulation system comprises an enclosure mounted within the chamber and at least one inlet formed in the enclosure for receiving air from the chamber. A pair of counter rotating fans are mounted within the enclosure adjacent the inlet for circulating the air and at least one air diverter plate is mounted within the enclosure adjacent the fan for diverting the circulating air substantially across the width of the enclosure. At least one air outlet is formed in the enclosure for introducing circulating air into the chamber about the product being tested or processed.

The present invention additionally includes an air circulation system mounted within a chamber. The chamber receives a product to be tested or processed. The air circulation system has at least one inlet for receiving air from the chamber and at least one air outlet for introducing circulating air into the chamber about the product being tested or processed. The air circulation system comprises a first fan rotating in a first rotating direction for circulating the air and a second fan rotating in a second rotating direction for circulating the air wherein the first rotation direction is substantially opposite the second rotation direction.

The present invention further includes a method for circulating air within a chamber. The chamber receives a product to be tested or processed. The air circulation system comprises mounting an enclosure within the chamber, driving air through the enclosure, and diverting the driven air substantially across the width of the enclosure

BRIEF DESCRIPTION OF THE DRAWINGS

The accompanying drawings, which are incorporated in and form a part of the specification, illustrate preferred embodiments of the present invention, and together with the descriptions serve to explain the principles of the invention.

DETAILED DESCRIPTION OF THE PREFERRED EMBODIMENTS

Figure 1:
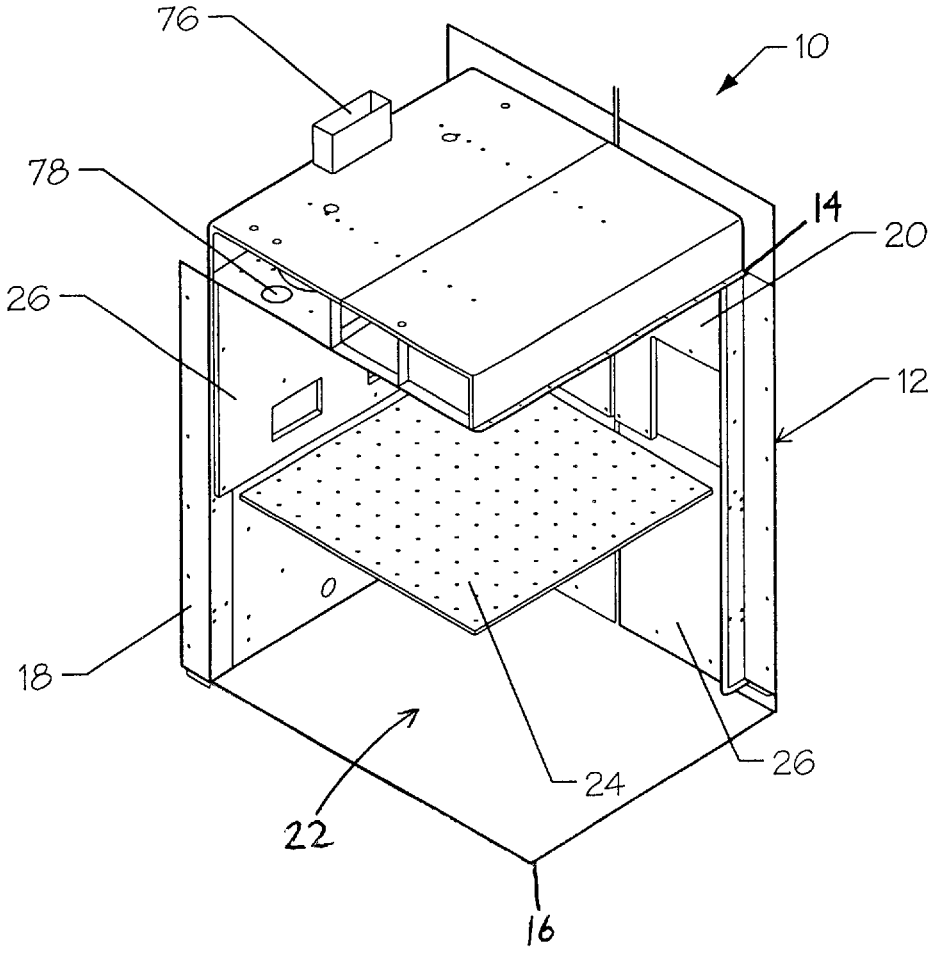
FIG. 1 is a perspective view illustrating an air circulation system for a chamber, constructed in accordance with the present invention, with air circulation system being a one-piece plenum mounted along a top wall of the chamber.

As illustrated in FIG. 1, the present invention is an air circulation system, indicated generally at 10, for circulating air within a chamber 12. The chamber 12 tests the reliability, durability, and/or processing of manufactured products (not shown) mounted within the chamber 12. It should be noted that the chamber 12 can be a thermal chamber having a heating unit for heating the circulating air and a cooling unit for cooling the circulating air within the chamber and/or a refrigeration chamber having only a refrigeration unit for cooling the circulating air within the chamber 12. The heating unit and cooling systems will be described in further detail below.

As illustrated in FIG. 1, the chamber 12 includes a top wall 14, a bottom wall 16 substantially opposite the top wall 14, a plurality of side walls 18 between the top wall 14 and the bottom wall 16, and an access door 20 defining an enclosed chamber 22. Still referring to FIG. 2, the chamber 12 can additionally include, although not required, a shaker table assembly 24 mounted on a foundation (not shown) within the enclosed chamber 22 and is operated such that the shaker table assembly 24 and the attached testable or manufactured product is vibrated. The foundation is an essentially vibration-free support for the shaker table assembly 24. Although typically supported from below, the shaker table assembly 24 can also be supported from any direction. While the air circulation system 10 of the present invention is a novel improvement for inclusion in a chamber, operation and construction of the shaker table 24 and the chamber 12 is further described in U.S. Pat. No. 5,589,637, assigned to the same assignee of the present application, and is hereby herein incorporated by reference.

The chamber 12 further includes an insulation blanket 26 secured to the side walls 18 and the access door 20 of the chamber 12. The insulation blankets 26 further insulate the chamber 12 to inhibit temperature loss through the side walls 18 and the access door 20 and maintain the desired, predetermined temperature of the circulating air through the chamber 12 and about the product being tested.

As illustrated in FIGS. 1–6, the air circulation system 10 is mounted to the top wall 14 of the chamber 12. The air circulation system 10 circulates air, either heated, cooled, or ambient, about the product being tested within the chamber 12. The heated and cooled circulating air increases the stress on the product being tested to assist in determining durability and life of the product. The actual heating and cooling of the circulating air will be described in further detail below.

The air circulation system 10 defines an enclosure 30 for receiving components of the air circulation system 10. The enclosure 30 is preferably constructed to be installed to the top wall 14 within the chamber 12 in a single unit, i.e., a one-piece plenum, thereby improving air flow through the enclosure 30 of the air circulation system 10 and the enclosed chamber 22 of the chamber 12. A plurality of fastening mechanisms (not shown), e.g., screws, rivets, etc. maintain the enclosure 30 within the chamber 12. In a preferred embodiment, the enclosure 30 is pop riveted to the side walls 18 of the chamber 12. A gasket (not shown) between the walls of the chamber 12 and between the enclosure 30 and the side walls 18 of the chamber 12 to further insulate the chamber 12 from heating and cooling losses.

The enclosure 30 is preferably constructed from a light gauge, stainless steel material and is formed and welded into the single unit for ease in installation. It should be noted that while the enclosure 30 of the air circulation system 10 has been described as being constructed from a light gauge, stainless steel material, it is within the scope of the present invention to construct the enclosure 30 from other materials including, but not limited to, other metals, plastic, ceramics, etc. Furthermore, the enclosure 30 can be defined by a plate (not shown) extending across the width of the chamber 12.

The air circulation system 10 further includes at least two counter rotating fans 32, a first fan 32*a* and a second fan 32*b*, for drawing air into the enclosure 30 of the air circulation system 30 from within the enclosed chamber 22 of the chamber 12 and driving the air through the enclosure 30 to exit the enclosure 30 from a plurality of outlet ports 34 for directing the air back toward the shaker table assembly 24 and the product being tested. In accordance with the present invention, the first fan 32*a* rotates in a direction substantially opposite the rotation of the second fan 32*b*. Each fan 32 preferably has a two (2 hp) horsepower motor and a blower wheel diameter of approximately fourteen (14") inches to fifteen (15") inches, although other size fans are within the scope of the present invention.

Figure 4:
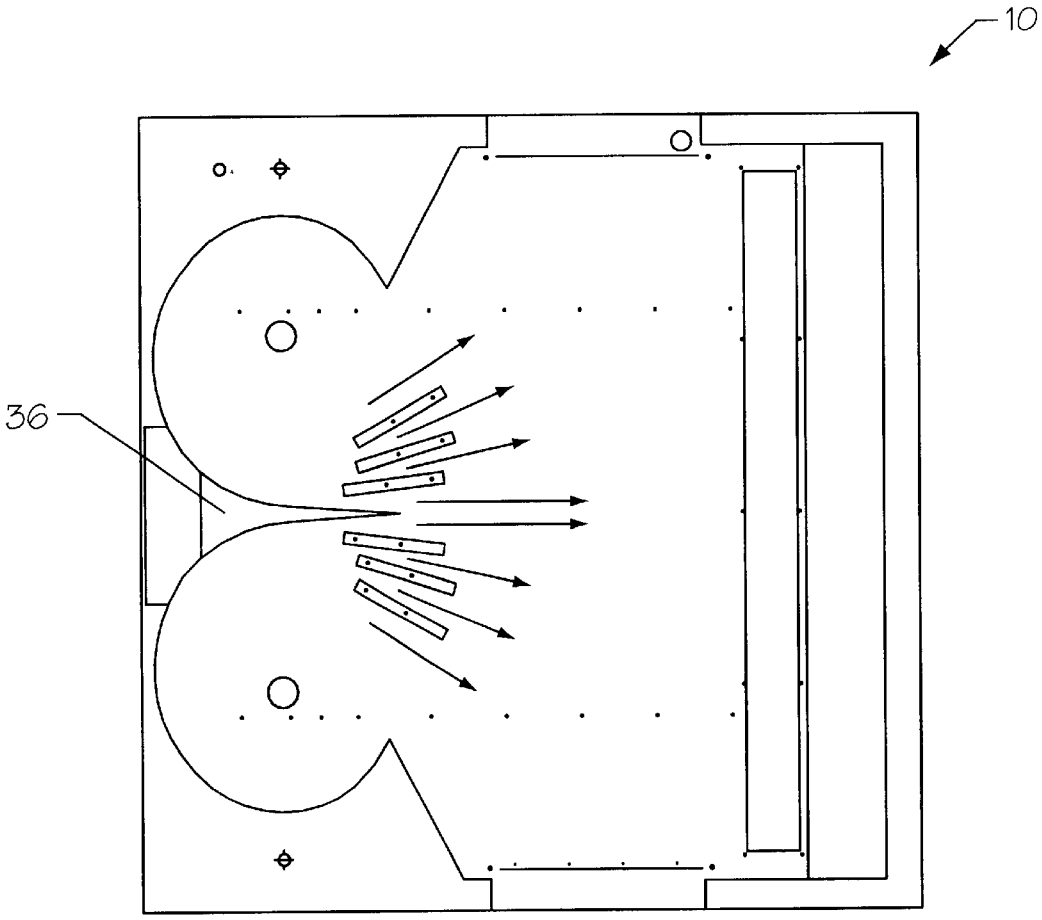
FIG. 4 is a top view illustrating the air circulation system for a chamber of FIG. 1, constructed in accordance with the present invention, with the airflow traveling through the diverters and spreading across the width of the air circulation being noted.

The inventors of the present application have found that by using the counter rotating fans 32, as described therein, there is less air diversion in an area 36, as illustrated in FIG. 4, behind the counter rotating fans 32 and, unlike conventional chambers, thereby increasing the volume of air flow through the enclosure 30. In fact, the counter rotating fans 32 increase the air flow volume through the enclosure 30 of the air circulation system 10 with an efficiency between approximately seventy (70%) percent and approximately ninety (90%) percent as compared to conventional chambers which typically have an efficiency of approximately fifty (50%) percent.

Figure 8:
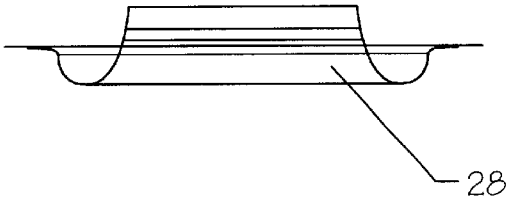
FIG. 8 is an elevational side view illustrating an inlet cone for the air circulation system, constructed in accordance with the present invention.
Figure 9:
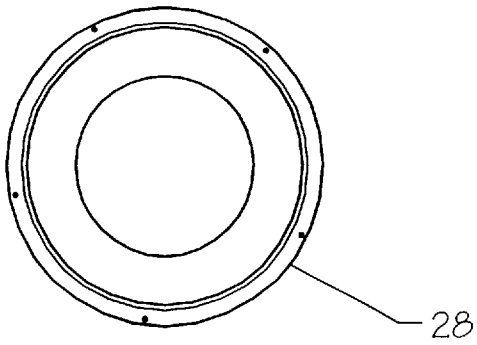
FIG. 9 is a top view illustrating the inlet cone for the air circulation system of FIG. 8, constructed in accordance with the present invention.
Figure 10:
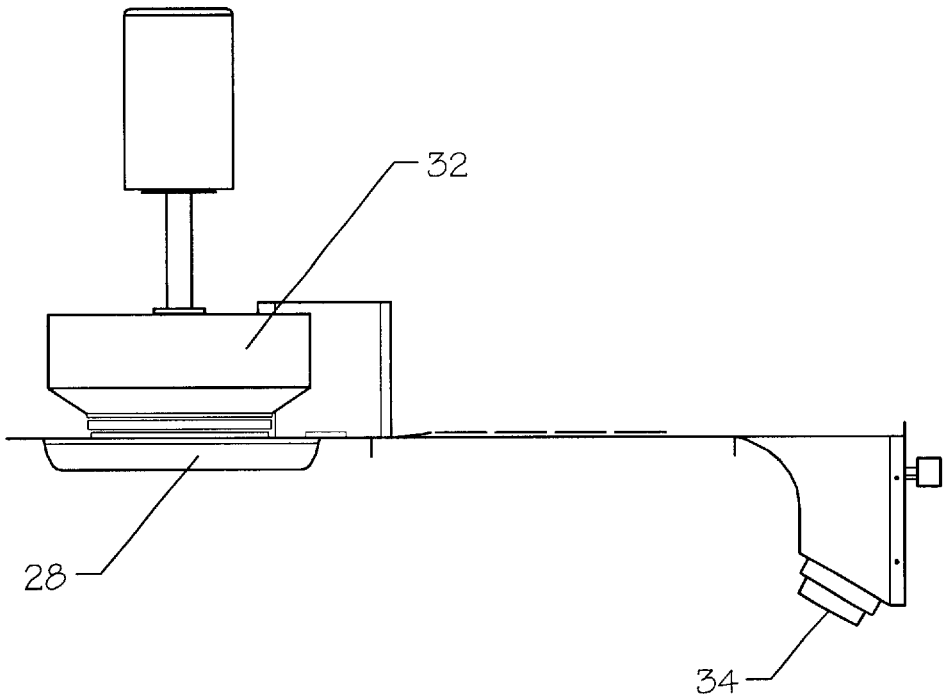
FIG. 10 is an elevational side view illustrating a counter-rotating fan for the air circulation system for a chamber, constructed in accordance with the present invention.

As illustrated in FIGS. 8 and 9, each counter rotating fan 32 of the air circulation system 10 of the present invention has an inlet cone 28 mounted to the enclosure 30 and extending into the enclosed chamber 22. Each inlet cone 28 provides a curved entrance for the circulating air entering the fan 28 thereby eliminating the sharp angles present in conventional fans and allowing a smooth transition and less disruption of the airflow entering the fans 32 from the enclosed chamber 22. By providing the inlet cones 28 with an entrance curved in the direction of the airflow, the air is directly directed into the counter rotating fans 32 thereby minimizing the height of the enclosure 30 of the air circulation system 10 and increasing the height of the enclosed chamber 22.

As the counter rotating fans 32 draw the air from within the enclosed chamber 22 of the chamber 12 and directs the air through the enclosure 30 of the air circulation system 10, a plurality of air diverter plates 38 are provided to increase the efficiency of the air flow through the enclosure 30 and to evenly distribute the air across a heating unit 42. The heating unit 42 will be described in further detail below.

Preferably, the air diverter plates 38 are constructed into two separate diverter plate units 40 and positioned within the enclosure 30 prior to mounting the enclosure 30 to the top wall 14 of the chamber 12. This allows the air diverter plates 38 to be inserted into the enclosure 30 in an easy and inexpensive manner. Furthermore, since the air diverter plates 38 span the entire height of the enclosure 30, the air diverter plates 38 provide additional center support for the enclosure 30 thereby inhibiting the enclosure 30 from deforming in the z-direction.

Figure 11:
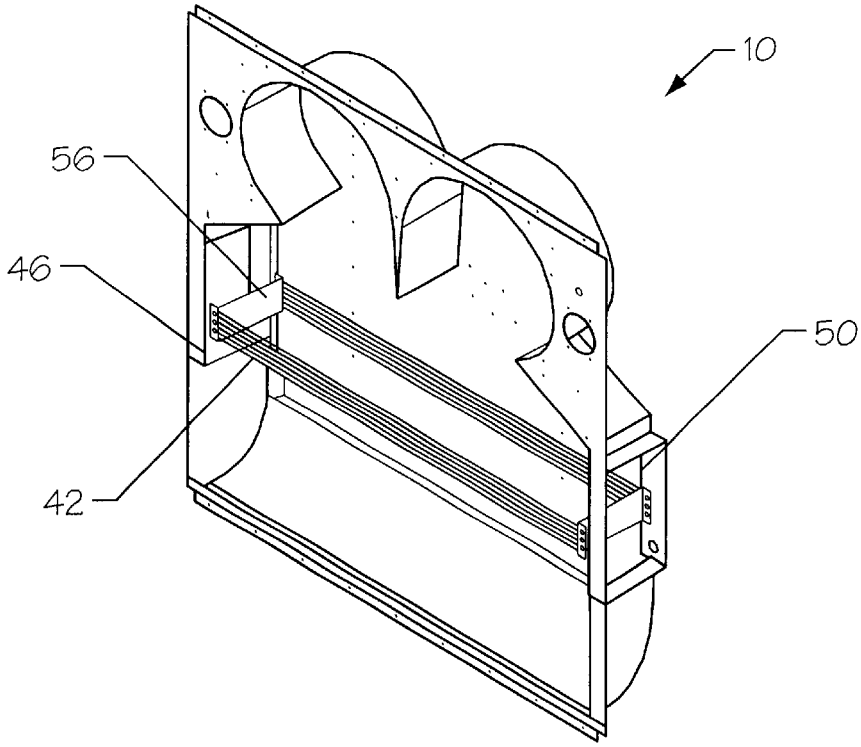
FIG. 11 is a perspective view illustrating the air circulation system for a chamber, constructed in accordance with the present invention, with a heating unit having a plurality of heating frames for elevating the temperature of the air circulating through the air circulation system.
Figure 12:
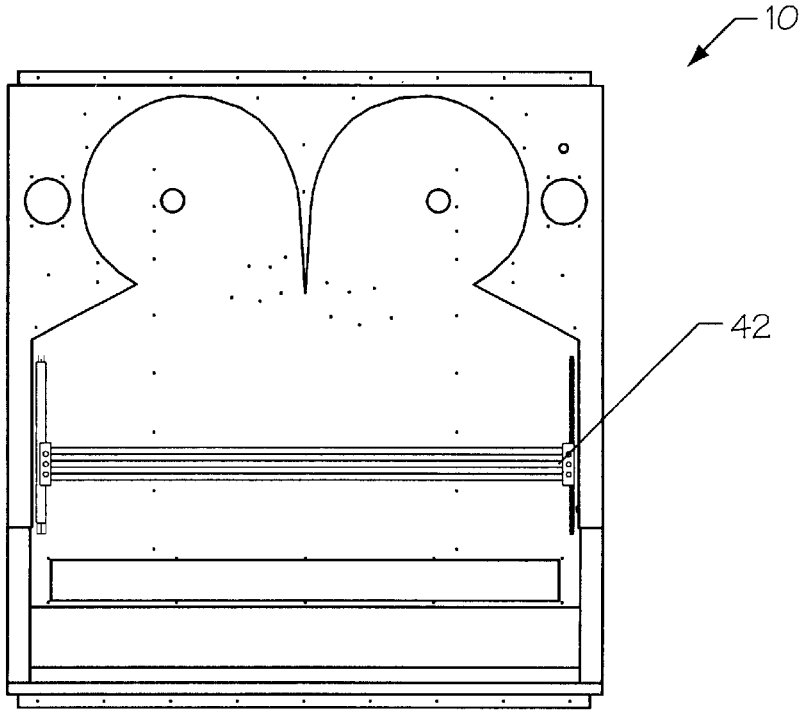
FIG. 12 is a bottom view illustrating the air circulation system for a chamber of FIG. 11, constructed in accordance with the present invention, with the heating unit.
Figure 13:
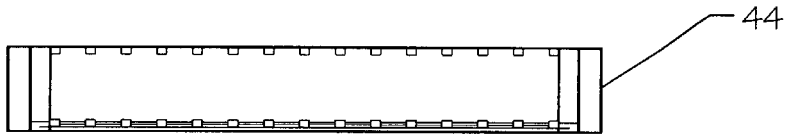
FIG. 13 is a front elevational view of a heater frame of the heating unit, constructed in accordance with the present invention.
Figure 14:
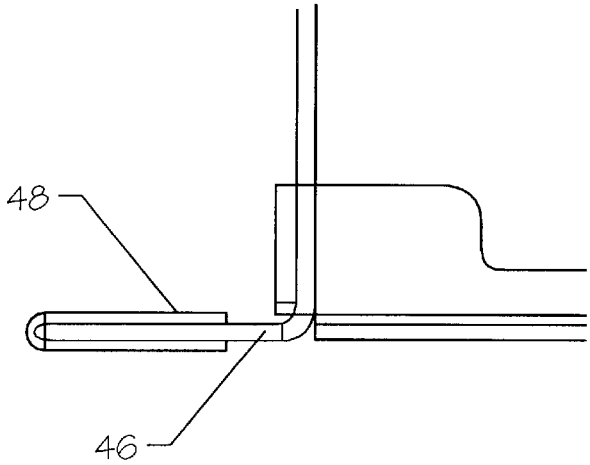
FIG. 14 is a side elevational view of a heating component bracket for securing together a plurality of heating frames, constructed in accordance with the present invention.
Figure 15:
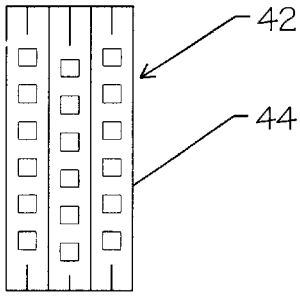
FIG. 15 is an end view of a plurality of heating frames secured together by a heating component bracket, constructed in accordance with the present invention.
Figure 16:
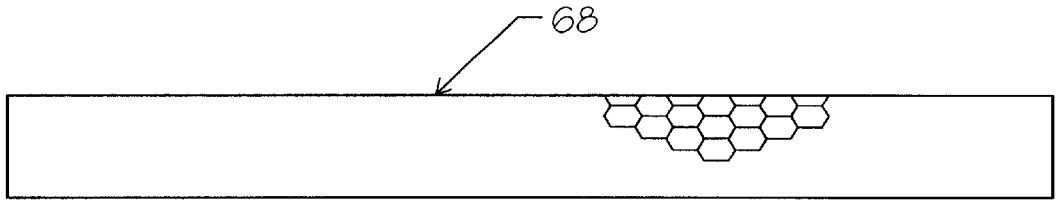
FIG. 16 is a side view illustrating of a circulation unit, constructed in accordance with the present invention.
Figure 17:
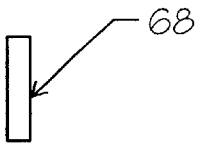
FIG. 17 is an end view illustrating the circulation unit of FIG 16, constructed in accordance with the present invention.
Figure 18:
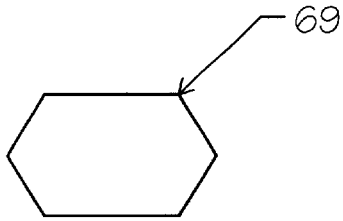
FIG. 18 is a side view illustrating a portion of the circulation unit of FIG. 16, constructed in accordance with the present invention.

As illustrated in FIGS. 11 and 12, the air circulation system 10 of the present invention further includes the heating unit 42, as mentioned briefly above, mounted within the enclosure 30 of the air circulation system 10 for increasing the temperature of the air to a desired, predetermined temperature as the air circulates through the enclosure 30. As illustrated in FIG. 13, preferably, the heating unit 42 is a modular heating system having individual heating frames 44. As illustrated in FIG. 14, each heating frame 44 has a protruding portion 46. The heating frames 44 are mounted in heating sets of three (3) individual heating frames 44 by a bracket 48 extending over the protruding portion 46 of each heating frame 44. As illustrated in FIG. 15, a bank of three (3) heating sets can be installed within the enclosure 30.

To install the heating unit 42 in the air circulation system 10 within the enclosure 30, the enclosure 30 includes a protrusion receiving slot 50 formed therein. As illustrated in FIG. 11, the protruding portions 46 at one end of the heating frames 44 are inserted into the protrusion receiving slot 50. A heating frame aperture 52 at the opposite end of the heating frames 44 is then aligned with a corresponding enclosure aperture 54. A fastening mechanism 56, such as a screw or bolt, is inserted and secured within the heating frame aperture 52 and the enclosing aperture 54. By providing a heating unit 42 as described and illustrated herein, installation of the heating unit 42 within the enclosure 30 can be accomplished in an easy and efficient manner.

In thermal chambers, the air circulation system 10 of the present invention further includes a cooling device 58 positioned within the chamber 12 for cooling the temperature of the air to a predetermined temperature as the air circulates through the enclosure 30 of the air circulating system 12. The cooling device 58 includes a distribution manifold 60 positioned within the side wall 18 of the chamber 12 and connected to a coolant supply (not shown) via an inlet pipe 62 or the like. Preferably, the coolant used for cooling the circulating air is liquid nitrogen ($LN_2$) or liquid carbon dioxide ($CO_2$) although other coolants are within the scope of the present invention. As noted before, the cooling of the circulating air can be accomplished by providing cooled coils for the circulating air to pass over or through, i.e., a refrigeration unit.

Figure 5:
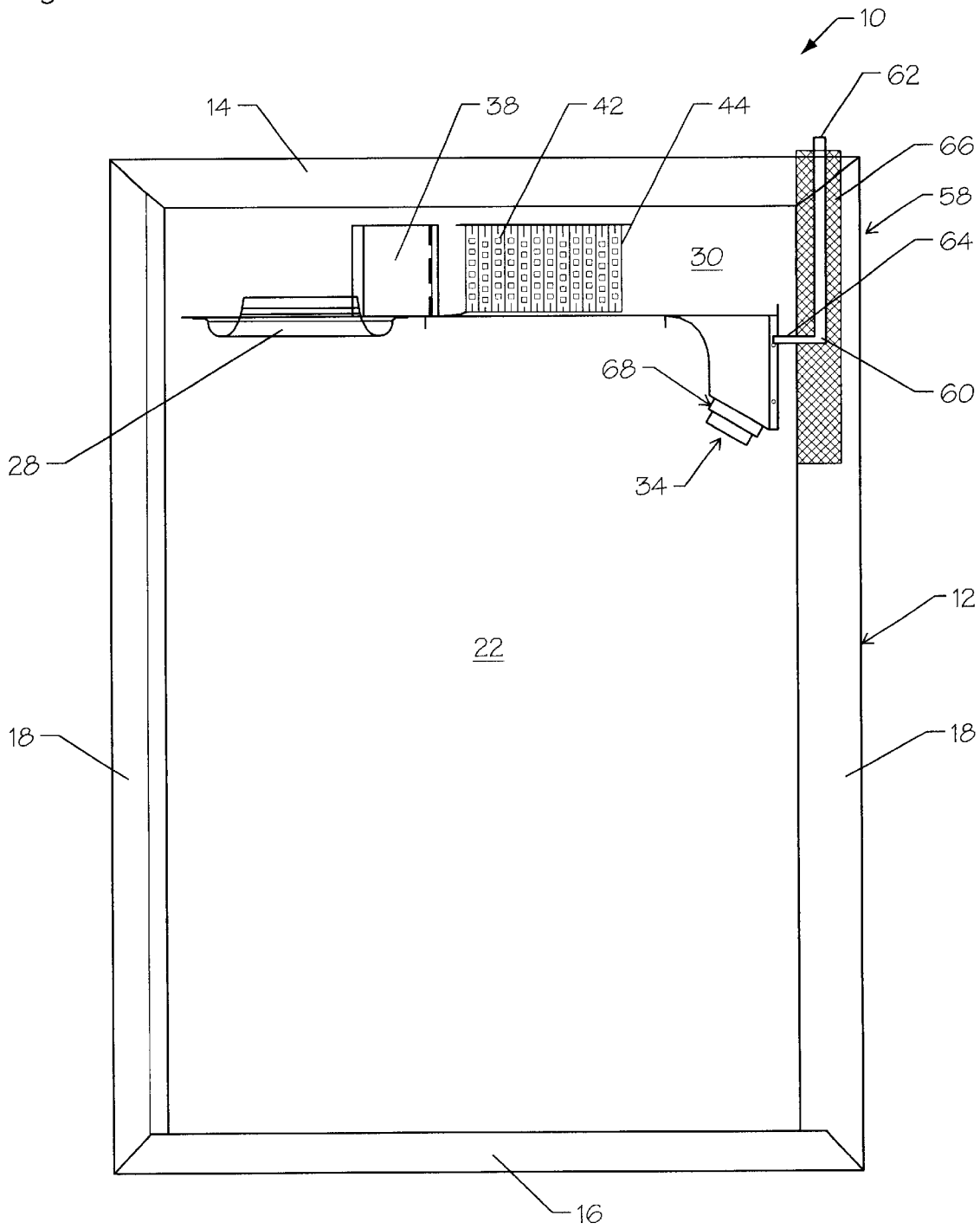
FIG. 5 is an elevational side view illustrating the air circulation system for a chamber, constructed in accordance with the present invention.
Figure 6:
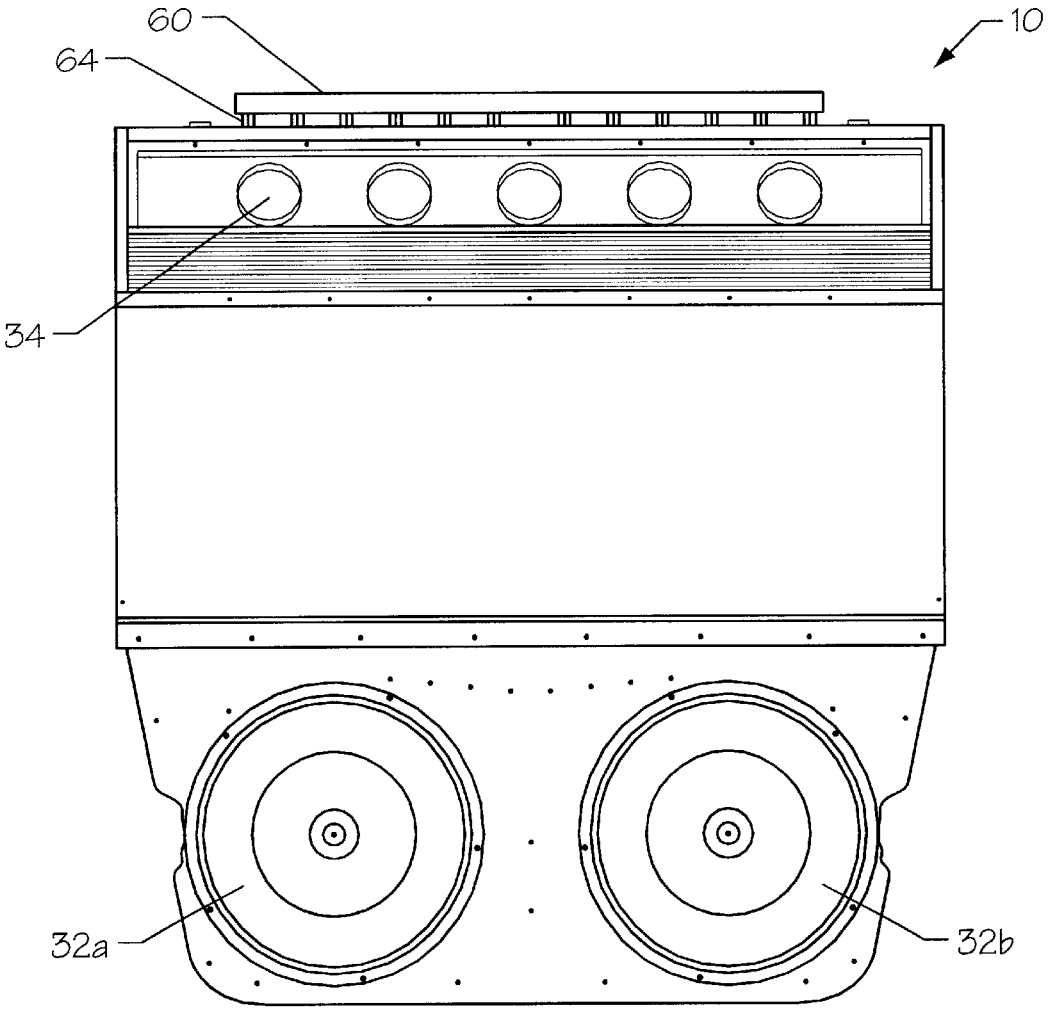
FIG. 6 is a bottom view illustrating the air circulation system for a chamber of FIG. 1, constructed in accordance with the present invention.
Figure 7:
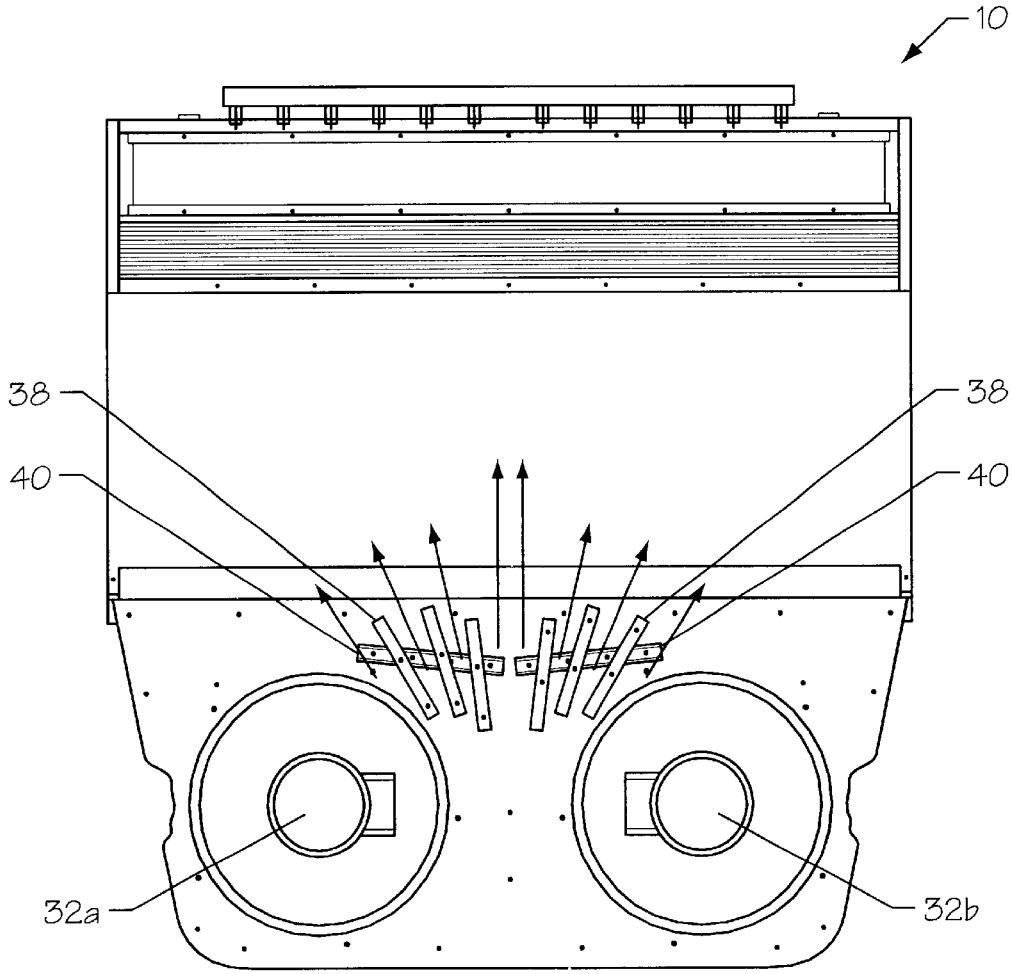
FIG. 7 is a top view illustrating the air circulation system for a chamber of FIG. 1, constructed in accordance with the present invention, indicating the direction of air flow within the chamber.

As mentioned above, the distribution manifold 60 is positioned within the side wall 18 of the chamber 12. The cooling device 58, including the distribution manifold 60, are insertable into and removable from within the chamber 12 as a one-piece unit for ease of installation, removal, and servicing. The cooling device 58 injects the coolant from the distribution manifold 60 into the circulating air within the enclosure 30 of the air circulation system 10 through a plurality of injection ports 64 extending through the side wall 18 of the chamber 12. The injection ports 64 can be a variety of sizes. For instance, with the distribution manifold 60, as illustrated in FIGS. 5–7, the distribution manifold 60 has a substantially T-shaped configuration. With such a configuration, the distribution manifold 60 preferably includes smaller diameter injection ports 64 nearingly adjacent the inlet pipe 62 and increasingly larger diameter injection ports 64 distant from the inlet pipe 62.

An insulation material 66 can be disposed about the distribution manifold 60 and the inlet pipe 62 to maintain the desired, predetermined temperature of the coolant therein. Preferably, the insulation material 66 is a plurality of cork granules although other types of insulation material 66 is within the scope of the present invention.

Preferably, the coolant is injected through the plurality of injection ports 64 into the circulating air at a point between the heating unit 42 and the outlet ports 34. For optimum cooling efficiency and minimal heat loss, the injection ports 64 are positioned nearingly adjacent the outlet ports 34 thereby allowing the cooled circulating air to circulate through the enclosed chamber 22 of the chamber 12, and thus the product being tested before the circulating air is circulated out of the enclosed chamber 22 into the enclosure 30 through the fans. By positioning the injection ports 48 closely adjacent the outlet ports 48, the coolant is initially being used to reduce the temperature of the product being tested and not for cooling the heating unit 42 and the enclosure 30 of the air circulation system 10. Therefore, the cooling device 58 of the present invention effectively reduces the amount of coolant use and increases the efficiency of the chamber 12.

As the coolant is injected into the circulating air through the injection ports 64, the coolant contacts and passes through a circulation unit 68 mounted immediately adjacent the injection ports 64 for substantially vaporizing the coolant prior to the coolant reaching the product being tested within the chamber 12 and for straightening the air flow as the air leaves the enclosure 30. Vaporization of the coolant is accomplished due to the fact that the temperature of the circulation unit 68 is greater than the boiling point of the coolant. As the cold coolant contacts the circulation unit 68, the coolant is vaporized and effectively mixed with the circulating air. It should be noted that in refrigeration and other similar chambers, the circulation unit 68 only straightens the air since vaporization is not necessary.

The circulation unit 68 of the air circulation system 10 of the present invention is preferably positioned between approximately fifteen (15") inches and twenty (20") inches from the injection ports 64 for optimum coolant vaporization. It should be noted, however, that positioning the circulation unit 68 at a distance less than approximately fifteen (15") inches from the injection ports 64 and at a distance greater than approximately twenty (20") inches from the injection ports 64 is within the scope of the present invention so long as the liquid nitrogen is sufficiently vaporized prior to circulating about the product being tested.

Figure 2:
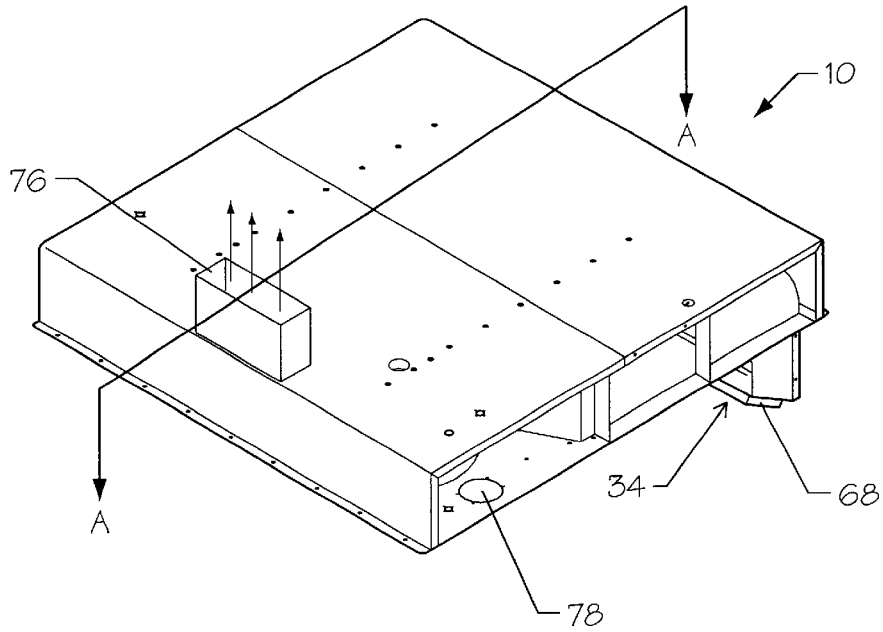
FIG. 2 is a perspective view illustrating the air circulation system for a chamber of FIG. 1, constructed in accordance with the present invention, with an air portal for allowing air to exit the chamber.
Figure 3:
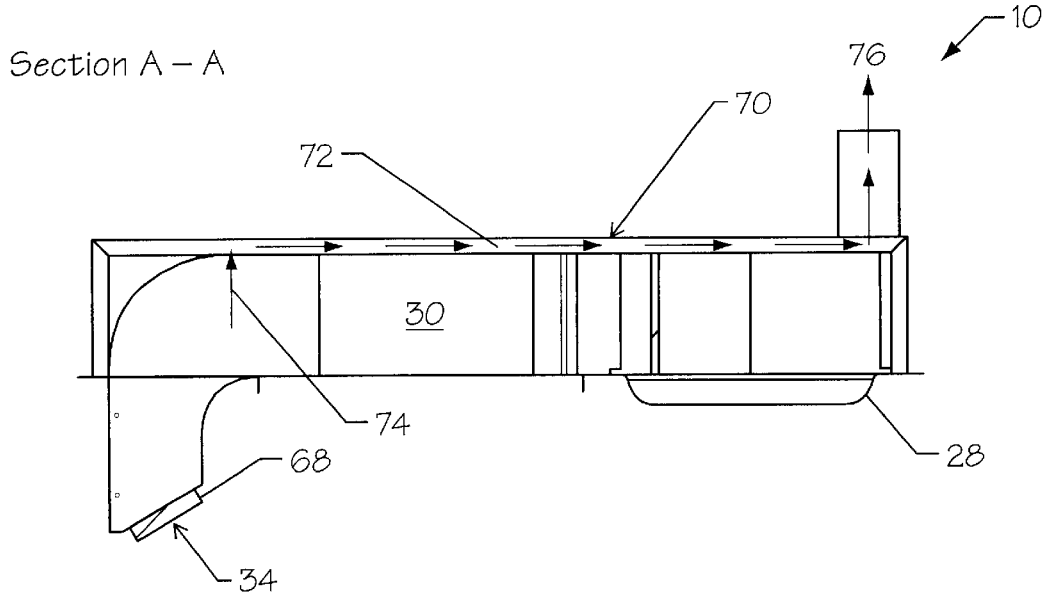
FIG. 3 is a sectional view illustrating the air circulation system for a chamber taken along line A—A, constructed in accordance with the present invention, with the secondary air path to heat and cool the one-piece plenum.

The inventors of the present invention have discovered that the circulating air which is normally exhausted from the chamber can be used to heat and/or cool the enclosure 30 of the air circulation system 10. Therefore, as illustrated in FIGS. 2 and 3, the air circulation system 10 includes a secondary exhaust system 70 for heating and cooling the enclosure 30. The secondary exhaust system 70 includes a space 72 between the enclosure 30 and the top wall 14 of the chamber 12. An exit portal 74 formed in the enclosure 30 distant from the fans 32 allows circulating air to exit the enclosure 30 and enter the space 72. As the circulating air enters the space 72 between the enclosure 30 and the top wall 14 of the chamber 12, the circulating air travels within the space 72 between the enclosure 30 and the top wall 14 of the chamber 12 until the circulating air exits the space 72 through an air exit opening 76 formed in the top wall 14 of the chamber 12 substantially above the fans 32.

The secondary exhaust system 70 of the air circulation system 10 of the present invention allows air, either heated or cooled, which would normally exit the enclosure 30 adjacent the fans 32 to assist in heating or cooling the enclosure 30 prior to exiting the chamber 12. The secondary exhaust system 70 assists in maintaining the desired temperature of the air circulating in the chamber 12 and reduces the amount of required heating by the heating unit and the amount cooling fluid necessary during operation of the chamber 12.

It is often desirable to have a light source within the enclosed chamber 22 of the chamber 12 to aid and assist the operator in testing the product. Therefore, an additional added feature for minimizing heat loss and controlling the temperature within the enclosed chamber 22 of the chamber 12 is provided. As illustrated in FIG. 2, at least one non-heat generating lighting source 78 can be mounted within the enclosed chamber 22. Preferably, the non-heat generating lighting source 78 are fiber-optic lights, but other types of non-heat generating light sources are within the scope of the present invention. The fiber-optic lights minimize the heat generated when lighting the enclosed chamber 22.

The air circulation system 10 of the present invention effectively increases the efficiency of the air flow through the chamber 12 and allows the easy installation, maintenance, and removal of components therein. Specially designed inlet cones allow air to enter the enclosure 30 in a substantially unimpeded manner and allows the height of the enclosure 30 to be minimized. Counter rotating fans 32*a*, 32*b* increase the volume of air flowing through the enclosure 30 and, thus within the chamber 12. Air diverter plates 38 are mounted adjacent the fans 32 to evenly distribute the air flow across the width of the enclosure 30 and through the heating unit 42, if present. A modular heating unit 42 can be constructed and installed within the enclosure 30 thereby allowing easy installation, maintenance, and replacement. A secondary exhaust system 70 is provided to gain full use of heated or cooled air to assist in heating or cooling the enclosure 30 thereby decreasing the amount of heating and/or cooling required.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

We claim:

1. An air circulation system mounted within a chamber, the chamber having a top wall receiving a product to be tested or processed, the air circulation system comprising:

an enclosure defined within the chamber, the enclosure having a top enclosure wall and a bottom enclosure wall, the top enclosure wall being mounted adjacent the top chamber wall creating an air circulation space therebetween;

at least one inlet formed in the enclosure for receiving air from the chamber;

a pair of fans mounted within the enclosure adjacent the inlet for circulating the air;

at least one air diverter plate mounted within the enclosure adjacent the fans for diverting the circulating air substantially across the width of the enclosure; and at least one air outlet formed in the enclosure for introducing circulating air into the chamber about the product being tested or processed.

2. The air circulation system of claim 1 and further comprising:

an air introduction opening in the top enclosure wall for introducing circulating air into the air circulation space;

an air exit opening formed in the top chamber wall for allowing the circulating air within the air circulation space to exit from the chamber such that the circulating air travels substantially along the length of the top wall of the enclosure prior to exiting the chamber.

3. The air circulation system of claim 1 and further comprising:

a first fan rotating in a first rotation direction; and a second fan rotating in a second rotation direction;

wherein the first rotation direction of the first fan is substantially opposite the second rotation direction of the second fan.

4. The air circulation system of claim 1 wherein the enclosure has a top enclosure wall and a bottom enclosure wall, and further wherein each air diverter plate extends substantially from the top enclosure wall to the bottom enclosure wall.

5. The air circulation system of claim 1 and further comprising:

a plurality of diverter plates, each diverter plate being angle relative to each adjacent diverter plate for diverting the circulating air substantially across the width of the enclosure.

6. The air circulation system of claim 1 and further comprising:

at least one diverter plate bracket for receiving at least one air diverter plate, the diverter plate bracket mounted to the enclosure.

7. The air circulation system of claim 1 and further comprising an air straightening means nearingly adjacent the air outlet.

8. The air circulation system of claim 1 and further comprising cooling means for cooling the circulating air and heating means for heating the circulating air.

9. The air circulation system of claim 1 and further comprising:

a heating unit mounted within the enclosure for heating the circulating air.

10. The air circulation system of claim 9 wherein the heating unit includes a plurality of heating frames, each heating frame being secured to an adjacent heating frame by a heating unit bracket.

11. The air circulation system of claim 10 wherein each heating frame having a protrusion and the enclosure having a receiving slot, the protrusion of each heating frame being received by the receiving slot.

12. The air circulation system of claim 1 and further comprising:

insulation means mounted to the walls of the chamber for thermally isolating the chamber.

13. The air circulation system of claim 1 and further comprising:

a non-heat generating light source.

14. The air circulation system of claim 1 and further comprising:

an inlet cone mounted to the enclosure adjacent the fans, the inlet cone being curved in the direction of the airflow.

15. The air circulation system of claim 1 wherein the enclosure is defined by a plate extending across the width of the chamber.

16. In an air circulation system mounted within a chamber, the chamber receiving a product to be tested or processed, the air circulation system having at least one inlet for receiving air from the chamber and at least one air outlet for introducing circulating air into the chamber about the product being tested or processed, the improvement comprising:

a first fan rotating in a first rotating direction for circulating the air; and a second fan rotating in a second rotating direction for circulating the air;

wherein the first rotation direction of the first fan is substantially opposite the second rotation direction of the second fan.

17. The improvement of claim 16 and further comprising:

a first inlet cone directing the circulating air into the first fan; and a second inlet cone directing circulating air into the second fan;

wherein each inlet cone is curved in the direction of the airflow.

18. The improvement of claim 17 and further comprising:

at least one air diverter plate positioned adjacent the first fan and the second fan for diverting the circulating air.

19. The improvement of claim 18 and further comprising:

a plurality of diverter plates, each diverter plate being angle relative to each adjacent diverter plate for diverting the circulating air substantially across the width of the chamber.

20. The improvement of claim 16 wherein the chamber has a top wall, and further comprising:

an enclosure mounted adjacent the top wall of the chamber creating an air circulation space therebetween.

21. The improvement of claim 20 and further comprising:

an air introduction opening in the enclosure for introducing circulating air into the air circulation space;

an air exit opening formed in the chamber for allowing the circulating air within the air circulation space to exit from the chamber such that the circulating air travels substantially along the length of the enclosure prior to exiting the chamber.

22. The improvement of claim 16 and further comprising:

a heating unit mounted within the chamber for heating the circulating air.

23. A method for circulating air within a chamber, the chamber having a top wall and receiving a product to be tested or processed, the air circulation system comprising:

defining an enclosure within the chamber;

driving air through the enclosure;

diverting the driven air substantially across the width of the enclosure; and creating an air circulation space between the enclosure and the top wall of the chamber.

24. The method of claim 23 and further comprising:

providing a plurality of diverter plates, each diverter plate being angled relative to each adjacent diverter plate for diverting the circulating air substantially across the width of the enclosure.

25. The method of claim 23 and further comprising:

introducing circulating air into the air circulation space;

an air exit opening formed in the chamber for allowing the circulating air within the air circulation space to exit from the chamber such that the circulating air travels substantially along the length of the enclosure prior to exiting the chamber.

26. The method of claim 23 and further comprising:

rotating a first fan in a first rotation direction; and rotating a second fan in a second rotation direction, the second direction being substantially opposite the first rotation direction.

27. The method of claim 23 and further comprising:

providing a plurality of heating frames; and securing each heating frame to an adjacent heating frame by a heating unit bracket.

28. An air circulation system mounted within a chamber, the chamber receiving a product to be tested or processed, the air circulation system comprising:

an enclosure defined within the chamber;

at least one inlet formed in the enclosure for receiving air from the chamber;

a pair of fans mounted within the enclosure adjacent the inlet for circulating the air, the pair of fans including a first fan rotating in a first rotation direction and a second fan rotating in a second rotation direction wherein the first rotation direction of the first fan is substantially opposite the second rotation direction of the second fan;

at least one air diverter plate mounted within the enclosure adjacent the fans for diverting the circulating air substantially across the width of the enclosure; and at least one air outlet formed in the enclosure for introducing circulating air into the chamber about the product being tested or processed.

29. The air circulation system of claim 28 wherein the chamber has a top chamber wall and the enclosure has a top enclosure wall and a bottom enclosure wall, the top enclosure wall being mounted adjacent the top chamber wall creating an air circulation space therebetween.

30. The air circulation system of claim 28 and further comprising:

an air introduction opening in the top enclosure wall for introducing circulating air into the air circulation space;

an air exit opening formed in the top chamber wall for allowing the circulating air within the air circulation space to exit from the chamber such that the circulating air travels substantially along the length of the top wall of the enclosure prior to exiting the chamber.

31. The air circulation system of claim 28 wherein the enclosure has a top enclosure wall and a bottom enclosure wall, and further wherein each air diverter plate extends substantially from the top enclosure wall to the bottom enclosure wall.

32. The air circulation system of claim 28 and further comprising:

a plurality of diverter plates, each diverter plate being angle relative to each adjacent diverter plate for diverting the circulating air substantially across the width of the enclosure.

33. The air circulation system of claim 28 and further comprising:

at least one diverter plate bracket for receiving at least one air diverter plate, the diverter plate bracket mounted to the enclosure.

34. The air circulation system of claim 28 and further comprising:

an air straightening means nearingly adjacent the air outlet.

35. The air circulation system of claim 28 and further comprising:

cooling means for cooling the circulating air and heating means for heating the circulating air.

36. The air circulation system of claim 28 and further comprising:

a heating unit mounted within the enclosure for heating the circulating air.

37. The air circulation system of claim 36 wherein the heating unit includes a plurality of heating frames, each heating frame being secured to an adjacent heating frame by a heating unit bracket.

38. The air circulation system of claim 37 wherein each heating frame having a protrusion and the enclosure having a receiving slot, the protrusion of each heating frame being received by the receiving slot.

39. The air circulation system of claim 28 and further comprising:

insulation means mounted to the walls of the chamber for thermally isolating the chamber.

40. The air circulation system of claim 28 and further comprising:

a non-heat generating light source.

41. The air circulation system of claim 28 and further comprising:

an inlet cone mounted to the enclosure adjacent the fans, the inlet cone being curved in the direction of the airflow.

42. The air circulation system of claim 28 wherein the enclosure is defined by a plate extending across the width of the chamber.

43. An air circulation system mounted within a chamber, the chamber receiving a product to be tested or processed, the air circulation system comprising:

an enclosure defined within the chamber;

at least one inlet formed in the enclosure for receiving air from the chamber;

a pair of fans mounted within the enclosure adjacent the inlet for circulating the air;

at least one air diverter plate mounted within the enclosure adjacent the fans for diverting the circulating air substantially across the width of the enclosure;

at least one air outlet formed in the enclosure for introducing circulating air into the chamber about the product being tested or processed; and a heating unit mounted within the enclosure for heating the circulating air, the heating unit having a plurality of heating frames, each heating frame being secured to an adjacent heating frame by a heating unit bracket;

wherein each heating frame has a protrusion and the enclosure having a receiving slot, the protrusion of each heating frame being received by the receiving slot.

44. The air circulation system of claim 43 wherein the chamber has a top chamber wall and the enclosure has a top enclosure wall and a bottom enclosure wall, the top enclosure wall being mounted adjacent the top chamber wall creating an air circulation space therebetween.

45. The air circulation system of claim 44 and further comprising:

an air introduction opening in the top enclosure wall for introducing circulating air into the air circulation space;

an air exit opening formed in the top chamber wall for allowing the circulating air within the air circulation space to exit from the chamber such that the circulating air travels substantially along the length of the top wall of the enclosure prior to exiting the chamber.

46. The air circulation system of claim 43 and further comprising:

a first fan rotating in a first rotation direction; and a second fan rotating in a second rotation direction;

wherein the first rotation direction of the first fan is substantially opposite the second rotation direction of the second fan.

47. The air circulation system of claim 43 wherein the enclosure has a top enclosure wall and a bottom enclosure wall, and further wherein each air diverter plate extends substantially from the top enclosure wall to the bottom enclosure wall.

48. The air circulation system of claim 43 and further comprising:

a plurality of diverter plates, each diverter plate being angle relative to each adjacent diverter plate for diverting the circulating air substantially across the width of the enclosure.

49. The air circulation system of claim 43 and further comprising:

at least one diverter plate bracket for receiving at least one air diverter plate, the diverter plate bracket mounted to the enclosure.

50. The air circulation system of claim 43 and further comprising:

an air straightening means nearingly adjacent the air outlet.

51. The air circulation system of claim 43 and further comprising:

cooling means for cooling the circulating air and heating means for heating the circulating air.

52. The air circulation system of claim 43 and further comprising:

insulation means mounted to the walls of the chamber for thermally isolating the chamber.

53. The air circulation system of claim 43 and further comprising:

a non-heat generating light source.

54. The air circulation system of claim 43 and further comprising:

an inlet cone mounted to the enclosure adjacent the fans, the inlet cone being curved in the direction of the airflow.

55. The air circulation system of claim 43 wherein the enclosure is defined by a plate extending across the width of the chamber.

56. An air circulation system mounted within a chamber, the chamber receiving a product to be tested or processed, the air circulation system comprising:

an enclosure defined within the chamber;

at least one inlet formed in the enclosure for receiving air from the chamber;

a pair of fans mounted within the enclosure adjacent the inlet for circulating the air;

at least one air diverter plate mounted within the enclosure adjacent the fans for diverting the circulating air substantially across the width of the enclosure;

at least one air outlet formed in the enclosure for introducing circulating air into the chamber about the product being tested or processed; and an inlet cone mounted to the enclosure adjacent the fans, the inlet cone being curved in the direction of the airflow.

57. The air circulation system of claim 56 wherein the chamber has a top chamber wall and the enclosure has a top enclosure wall and a bottom enclosure wall, the top enclosure wall being mounted adjacent the top chamber wall creating an air circulation space therebetween.

58. The air circulation system of claim 57 and further comprising:

an air introduction opening in the top enclosure wall for introducing circulating air into the air circulation space;

an air exit opening formed in the top chamber wall for allowing the circulating air within the air circulation space to exit from the chamber such that the circulating air travels substantially along the length of the top wall of the enclosure prior to exiting the chamber.

59. The air circulation system of claim 56 and further comprising:

a first fan rotating in a first rotation direction; and a second fan rotating in a second rotation direction;

wherein the first rotation direction of the first fan is substantially opposite the second rotation direction of the second fan.

60. The air circulation system of claim 56 wherein the enclosure has a top enclosure wall and a bottom enclosure wall, and further wherein each air diverter plate extends substantially from the top enclosure wall to the bottom enclose wall.

61. The air circulation system of claim 56 and further comprising:

a plurality of diverter plates, each diverter plate being angle relative to each adjacent diverter plate for diverting the circulating air substantially across the width of the enclosure.

62. The air circulation system of claim 56 and further comprising:

at least one diverter plate bracket for receiving at least one air diverter plate, the diverter plate bracket mounted to the enclosure.

63. The air circulation system of claim 56 and further comprising:

an air straightening means nearingly adjacent the air outlet.

64. The air circulation system of claim 56 and further comprising:

cooling means for cooling the circulating air and heating means for heating the circulating air.

65. The air circulation system of claim 56 and further comprising:

a heating unit mounted within the enclosure for heating the circulating air.

66. The air circulation system of claim 65 wherein the heating unit includes a plurality of heating frames, each heating frame being secured to an adjacent heating frame by a heating unit bracket.

67. The air circulation system of claim 66 wherein each heating frame having a protrusion and the enclosure having a receiving slot, the protrusion of each heating frame being received by the receiving slot.

68. The air circulation system of claim 56 and further comprising:

insulation means mounted to the walls of the chamber for thermally isolating the chamber.

69. The air circulation system of claim 56 and further comprising:

a non-heat generating light source.

70. The air circulation system of claim 56 wherein the enclosure is defined by a plate extending across the width of the chamber.

71. A method for circulating air within a chamber, the chamber receiving a product to be tested or processed, the air circulation system comprising:

defining an enclosure within the chamber;

driving air through the enclosure;

diverting the driven air substantially across the width of the enclosure;

rotating a first fan in a first rotation direction; and rotating a second fan in a second rotation direction, the second direction being substantially opposite the first rotation direction.

72. The method of claim 71 and further comprising:

providing a plurality of diverter plates, each diverter plate being angled relative to each adjacent diverter plate for diverting the circulating air substantially across the width of the enclosure.

73. The method of claim 71 wherein the chamber has a top wall and further comprising:

creating an air circulation space between the enclosure and the top wall of the chamber.

74. The method of claim 73 and further comprising:

introducing circulating air into the air circulation space;

an air exit opening formed in the chamber for allowing the circulating air within the air circulation space to exit from the chamber such that the circulating air travels substantially along the length of the enclosure prior to exiting the chamber.

75. The method of claim 73 and further comprising:

providing a plurality of heating frames; and securing each heating frame to an adjacent heating frame by a heating unit bracket.

* * * * *